US010427822B2

(12) United States Patent
Viale et al.

(10) Patent No.: US 10,427,822 B2
(45) Date of Patent: Oct. 1, 2019

(54) CONTAINERS AND RECYCLABLE TAMPER-EVIDENT CLOSURE ASSEMBLIES

(71) Applicant: Guala Closures S.p.A., Alessandria (IT)

(72) Inventors: Luca Viale, Alessandria (IT); Marco Giovannini, Luxembourg (LU)

(73) Assignee: GUALA CLOSURES S.P.A., Alessandria (AL) (IT)

( * ) Notice: Subject to any disclaimer, the term of this patent is extended or adjusted under 35 U.S.C. 154(b) by 0 days.

(21) Appl. No.: 15/756,249

(22) PCT Filed: Jul. 21, 2016

(86) PCT No.: PCT/IB2016/054347
§ 371 (c)(1),
(2) Date: Feb. 28, 2018

(87) PCT Pub. No.: WO2017/037551
PCT Pub. Date: Mar. 9, 2017

(65) Prior Publication Data

US 2018/0244421 A1 Aug. 30, 2018

(30) Foreign Application Priority Data

Sep. 3, 2015 (IT) ..... 102015000048435

(51) Int. Cl.
*B65D 1/02* (2006.01)
*B65D 41/34* (2006.01)

(52) U.S. Cl.
CPC ..... *B65D 1/0238* (2013.01); *B65D 1/023* (2013.01); *B65D 1/0246* (2013.01);
(Continued)

(58) Field of Classification Search
CPC .... B65D 1/0238; B65D 1/023; B65D 1/0223; B65D 1/0246; B65D 1/0253;
(Continued)

(56) References Cited

U.S. PATENT DOCUMENTS 3,001,657 A 9/1961 Gamble
3,968,894 A * 7/1976 Herrmann ..... B65D 50/041 215/220

(Continued)

FOREIGN PATENT DOCUMENTS

AT 413816 B 6/2006
DE 1432248 A1 4/1969

(Continued)

OTHER PUBLICATIONS

International Search Report and Written Opinion dated Oct. 20, 2016, in PCT Application No. PCT/IB2016/054347, 10 pages.

*Primary Examiner* — Robert J Hicks
(74) *Attorney, Agent, or Firm* — MH2 Technology Law Group LLP

(57) ABSTRACT

An assembly includes a container with a neck and a tamper-evident closure coupled to the container. The neck has a projection with a groove and a ramp. The tamper-evident closure includes a skirt with two portions engaged with the groove and the ramp. The skirt may be rotated relative to the neck to enlarge a diameter of the skirt and disengage the skirt from the neck.

20 Claims, 5 Drawing Sheets

(52) U.S. Cl.
CPC ..... *B65D 1/0253* (2013.01); *B65D 41/348* (2013.01); *B65D 41/3485* (2013.01); *B65D 2101/0023* (2013.01); *B65D 2101/0038* (2013.01)

(58) Field of Classification Search
CPC ..... B65D 17/402; B65D 17/462; B65D 17/4011; B65D 17/404; B65D 41/348; B65D 41/3485; B65D 41/48; B65D 41/3428; B65D 41/3409; B65D 41/32
USPC ..... 215/254, 253, 252, 250, 256, 329, 316, 215/44, 43; 220/276, 266, 265, 611
See application file for complete search history.

(56) References Cited

U.S. PATENT DOCUMENTS 4,156,490 A 5/1979 Peraboni
4,299,328 A * 11/1981 Ochs ..... B65D 41/3447 215/252
4,343,408 A * 8/1982 Csaszar ..... B65D 41/3452 215/252
4,380,299 A * 4/1983 Alejandro Llera ..... B29C 45/2618 215/252
4,567,993 A * 2/1986 Albrecht ..... B65D 41/3447 215/252
4,572,387 A * 2/1986 Luker ..... B65D 41/3452 215/252
6,929,137 B1 * 8/2005 Granger ..... B65D 41/045 215/219
2015/0246754 A1 * 9/2015 Bates ..... B65D 41/0464 220/300
2016/0075502 A1 * 3/2016 Patel ..... B65D 83/38 220/288
2018/0093802 A1 * 4/2018 Paganuzzi ..... B65D 50/041

FOREIGN PATENT DOCUMENTS

EP 0047854 A1 3/1982
FR 723220 4/1932
FR 1108212 B 1/1956
GB 362101 12/1931
GB 374394 6/1932
GB 407386 3/1934
GB 430600 6/1935
GB 459993 1/1937
GB 1033604 6/1966
GB 1114897 5/1968
GB 2078689 A 1/1982
GB 2261656 A 5/1993
LU 49121 A 9/1965
WO 98/09879 A1 3/1998
WO 2008/095863 A1 8/2008
WO 2012/150569 A1 11/2012

* cited by examiner

CONTAINERS AND RECYCLABLE TAMPER-EVIDENT CLOSURE ASSEMBLIES

CROSS-REFERENCE TO RELATED APPLICATION(S)

This application is a national stage entry from International Application No. PCT/IB2016/054347, filed on Jul. 21, 2016, in the Receiving Office ("RO/IB") of the International Bureau of the World Intellectual Property Organization ("WIPO"), and published as International Publication No. WO 2017/037551 A1 on Mar. 9, 2017; International Application No. PCT/IB2016/054347 claims priority from Italian Patent Application No. 102015000048435, filed on Sep. 3, 2015, in the Italian Patent and Trademark Office ("IPTO"), the entire contents of all of which are incorporated herein by reference.

TECHNICAL FIELD

The present invention relates to an assembly of a container and a recyclable tamper-evident closure.

BACKGROUND OF THE INVENTION

Tamper-evident closures are known in the art. These closures generally include a cap proper, which is removably associated with the rest of the closure, and a tamper-evident element, providing first-opening evidence.

In most closures, at least one element remains attached to the container after first opening. This element is obviously conceived and designed to remain attached to the container throughout the useful live of the container.

As concerns over the environmental impact of products increase, the need to reduce the environmental impact of safety closures has been increasingly felt.

A reduced environmental impact of an item is known to be obtained by making the item out of parts that are made of the same material or are easily separable.

In the particular case of safety closures, which typically comprise an element that is designed to remain on the container throughout the useful life of the latter, the container is not easily separated from the element attached thereto using standard separation techniques as used in the recycling industry.

Therefore, the element becomes a pollutant in the container recycling process.

WO 2008/95863, U.S. Pat. Nos. 4,156,490, 3,001,657, GB 407386, GB 374394, GB 362101, FR 1108212 and FR 723220 disclose containers having a neck with lower threads and upper threads, and having a closure applied thereto, with a lower portion engaged with the lower threads and an upper portion engaged with the upper threads. Upon first opening, the lower threads retain the lower portion on the container. Nevertheless, the container does not allow the lower portion to be removed after first opening.

The need is also felt to provide a container that allows easy separation of the closure, for improved recycling of the container, with no element of the closure becoming a pollutant in the container recycling process.

WO 2012/150569 discloses a container assembly with a tamper-evident closure in which the container neck has threads and an engagement surface extending over the threads along at last one longitudinal section of the neck. While this arrangement allows removal of the closure from the neck, it is still involves some complexity in the manufacture of the neck.

GB 2261656, AT 413816, GB 430,600, GB 459,993, WO 98/09879 disclose technical arrangements aimed at preventing accidental opening of the closure and/or at assisting opening of the container when no threads are provided, Therefore, in light of the above discussed prior art, the object of the present invention is to provide an assembly that allows complete and easy separation of a threaded tamper-evident closure from a container having a threaded neck.

SUMMARY OF THE INVENTION

According to the present invention, this object is fulfilled by an assembly as defined in claim 1.

By providing a neck with a groove and a ramp formed in a projection and engaging with respective portions of the skirt of the tamper-evident closure, the ramp may be used to enlarge the diameter of the portions of the skirt engaged in the groove to thereby easily separate the skirt from the container.

BRIEF DESCRIPTION OF THE DRAWINGS

The characteristics and advantages of the present invention will appear from the following detailed description of one practical embodiment, which is illustrated without limitation in the annexed drawings, in which.

DETAILED DESCRIPTION

Figure 1:
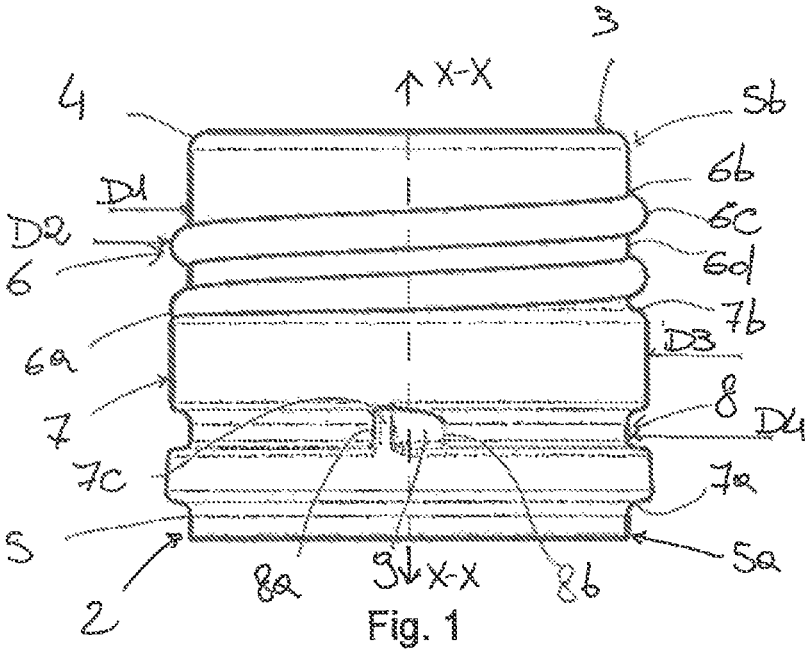
FIG. 1 shows a lateral view of a neck of a container according to a first embodiment of the invention.
Figure 2:
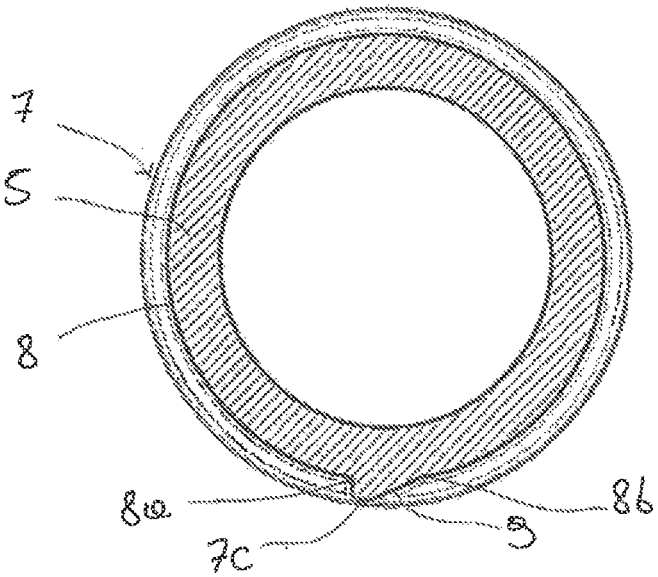
FIG. 2 shows a sectional view of the neck of FIG. 1.
Figure 3:
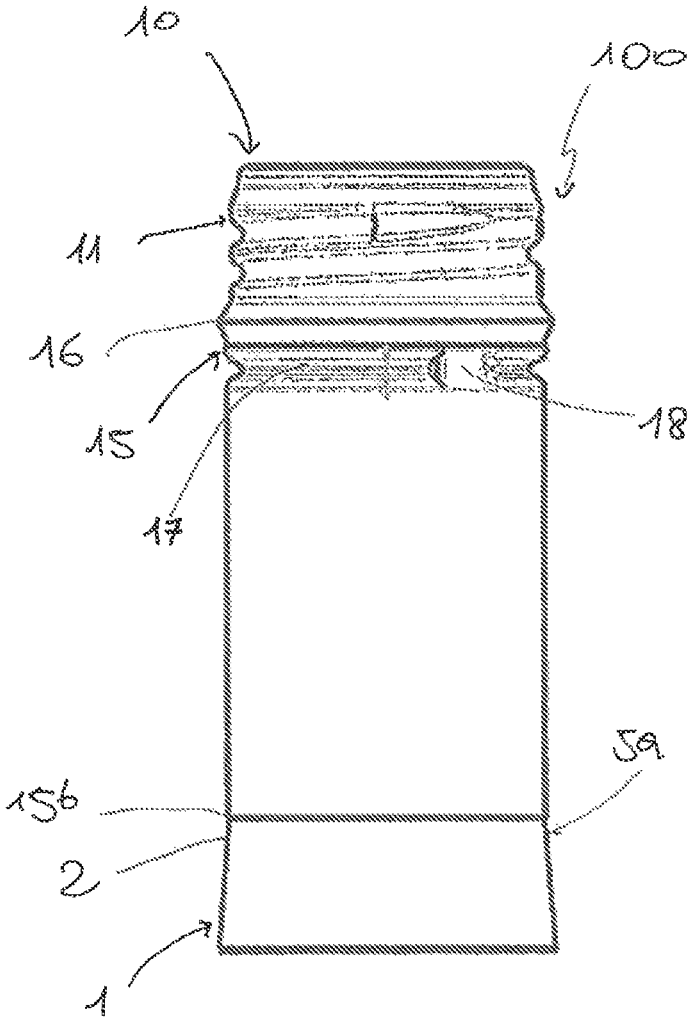
FIG. 3 shows a lateral view of an assembly of the neck of FIG. 1 and a closure according to a first embodiment of the invention.

Referring to the annexed figures, numeral 100 generally designates an assembly according to an embodiment of the present invention.

The assembly 100 comprises a container 1 and a tamper-evident closure 10.

The container 1 may be made of glass. The container 1 may be made of plastic. The tamper-evident closure 10 may be made of metal. The tamper-evident closure 10 may be made of aluminum.

The container 1 has a body (not shown) from which a neck 2 with a mouth 3 extends along a longitudinal axis. The mouth 3 defines the pouring orifice of the container 1 through which the contents of the container 1 may be poured.

The neck 2 extends along a longitudinal axis X-X and terminates on top with an annular rim 4 that delimits the mouth 3. The tamper-evident closure 10 is coupled to the container 1 to open and close the mouth 3, for the contents of the container 1 to be allowed to be or prevented from being poured respectively.

The neck 2 comprises a tubular wall 5 which extends along the longitudinal axis X-X between a lower portion 5*a* and an upper portion 5*b*, the annular rim 4 being formed at the upper end of the latter.

The neck 2 further comprises threads 6 formed outside the tubular wall 5, longitudinally beneath and adjacent to the annular rim 4. These threads 6 longitudinally extend between a lower end 6*a* and an upper end 6*b* and have crests 6*c* and troughs 6*d*. The troughs 6*d* define the minimum diameter D1 of the threads 6, whereas the crests 6*c* define the maximum diameter D2 of the threads 6.

The neck 2 further comprises a projection 7 formed outside the tubular wall 5 longitudinally beneath the threads 6, particularly longitudinally beneath the lower end 6*a* of the threads 6.

The projection 7 has a maximum diameter D3 that is greater than the minimum diameter D1 of the threads 6 and smaller than or equal to the maximum diameter D2 of the threads 6.

The projection 7 has a lower shoulder 7*a* and an upper shoulder 7*b*.

The lower shoulder 7*a* is joined to the lower portion 5*a* of the tubular wall 5, whereas the upper shoulder 7*b* is joined to the lower end 6*a* of the threads 6.

A groove 8 is formed in the projection 7 and extends in a circumferential or helical direction, between a first end 8*a* and a second end 8*b*, with a minimum diameter D4 that is smaller than the maximum diameter D3 of the projection 7 and smaller than the maximum diameter D2 of the threads 6.

The groove 8 is joined to the projection 7 by a ramp 9 which extends in the circumferential or helical direction, particularly to join the second end 8*b* of the groove 8 with a portion 7*c* of the projection 7, having a maximum diameter D3, to thereby join the minimum diameter D4 of the groove 8 to the maximum diameter D3 of the projection 7.

The tamper-evident closure 10 is coupled to the container 1, particularly to the neck 2, to open and close the mouth 3.

Such closure 10 comprises a closure member 11 and a skirt 15, which is connected to the closure member 11 through a frangible portion 16, which is configured to break upon first opening of the container 1 to allow removal of the closure member 11 from the neck 2.

The closure member 11 is configured to open and close the mouth 3 and, for this purpose, it comprises a top wall 12, preferably equipped with a gasket 12*a*, and a sleeve 13. The sleeve 13 is arranged coaxially outside the neck 2, particularly in the upper portion 5*b* of the neck 2.

The sleeve 13 longitudinally extends between the top wall 12 and a bottom edge 13*a* and comprises threads 14 removably engaged with the threads 6 of the container 1, to allow removal of the closure member 11 from the neck 2 of the container and hence to open and close the mouth 3. Particularly, the threads 14 of the sleeve 13 are formed by rolling the sleeve 13 on the threads 6 of the neck 2.

The skirt 15 is arranged coaxially outside the neck 2 and longitudinally beneath the sleeve 13. Preferably, the closure member 11 and the skirt 15 are formed of one piece and connected via the frangible portion 16. The frangible portion 16 may be formed using breakable axial bridges, a line of weakness, or a tear-off tab. Such frangible portion 16 provides evidence that the first opening of the closure 10 and, hence the container 1, has occurred.

The skirt 15 longitudinally extends with its maximum diameter D5 between a top edge 15*a* and a bottom edge 15*b*.

The top edge 15*a* of the skirt 15 is connected to the bottom edge 13*a* of the sleeve 13 via the frangible portion 16.

In one embodiment, the top edge 15*a* or the bottom edge 15*b* of the skirt 15 is joined to the lower portion Sa of the tubular wall 5.

The skirt 15 has a first attachment portion 17 and a second attachment portion 18.

The first attachment portion 17 is engaged inside the groove 8 to hold the skirt 15 longitudinally attached to the neck 2 upon first opening and extends with its minimum diameter D6 between the first end 8*a* and the second end 8*b* of the groove 8.

The second attachment portion 18 is engaged with the ramp 9 to join the first attachment portion 17 with the minimum diameter D6 to a portion of the skirt 18 having the maximum diameter D5.

Thus, as the ramp 9 joins the groove 8 with the minimum diameter D4 to the projection 7 with the maximum diameter D3, the second attachment portion 18 joins the first attachment portion 17 with the minimum diameter D6 with the skirt 15 with the maximum diameter D5.

Then, upon removal of the closure member 11 from the neck 2 upon first opening, during disposal of the container 1, the skirt 15 may be easily separated from the neck 2.

For this purpose, the skirt 15 can be rotated relative to the neck 2 in such a direction as to bring the first attachment portion 17 to engage against the ramp 9 and enlarge its diameter to the maximum diameter D5 of the skirt 15.

Figure 4:
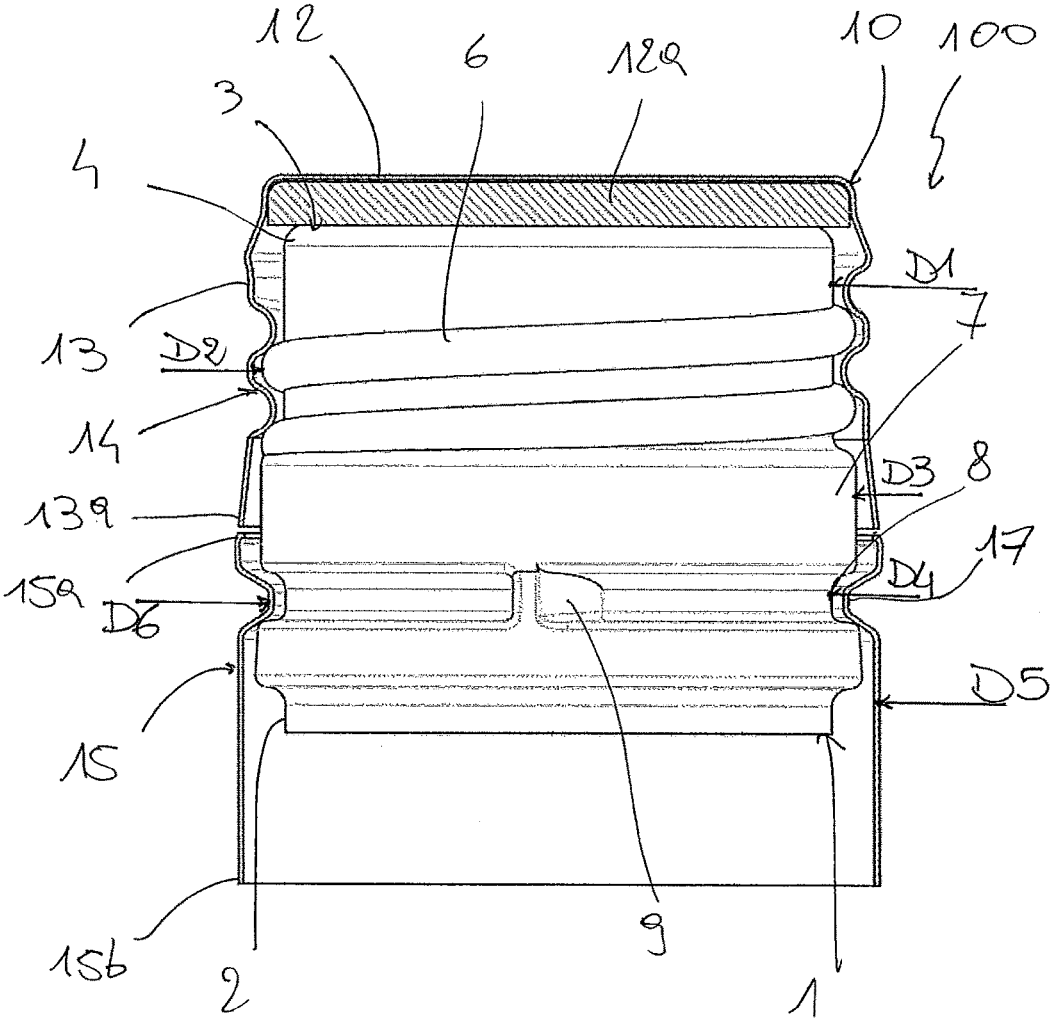
FIG. 4 shows a sectional view of the assembly of FIG. 3.
Figure 5:
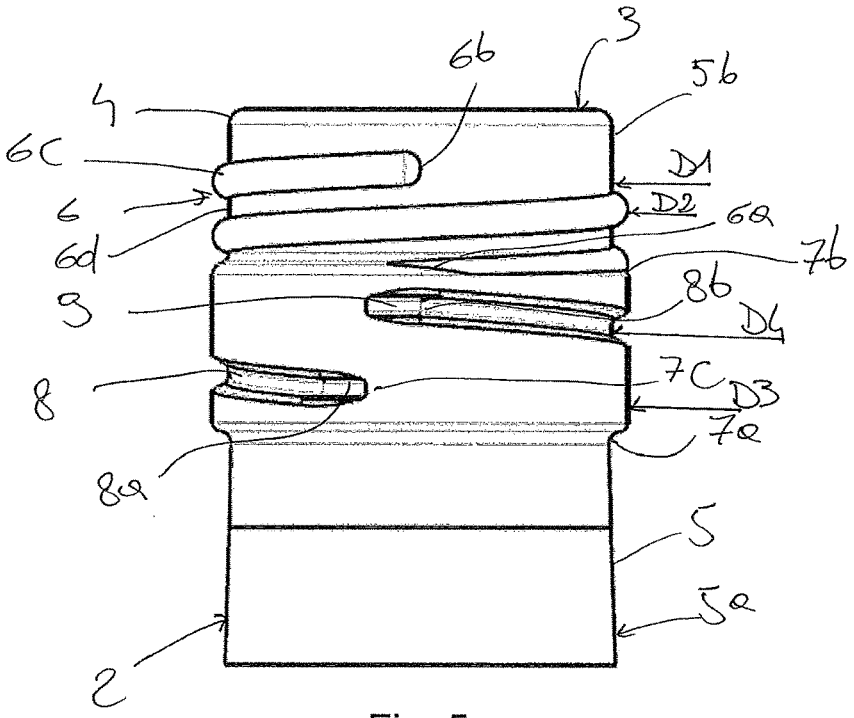
FIG. 5 shows a lateral view of a neck of a container according to a second embodiment of the invention.
Figure 6:
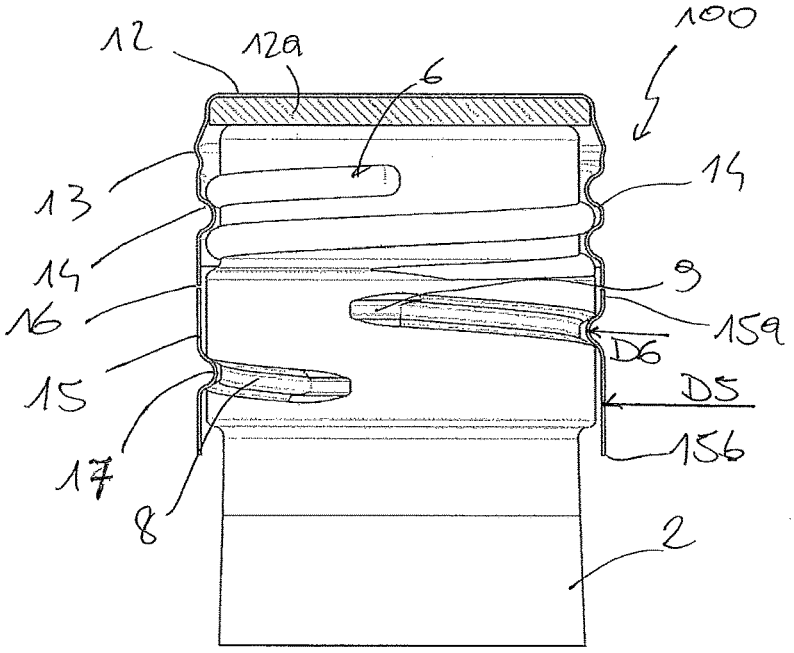
FIG. 6 shows a sectional view of the assembly of FIG. 7.
Figure 7:
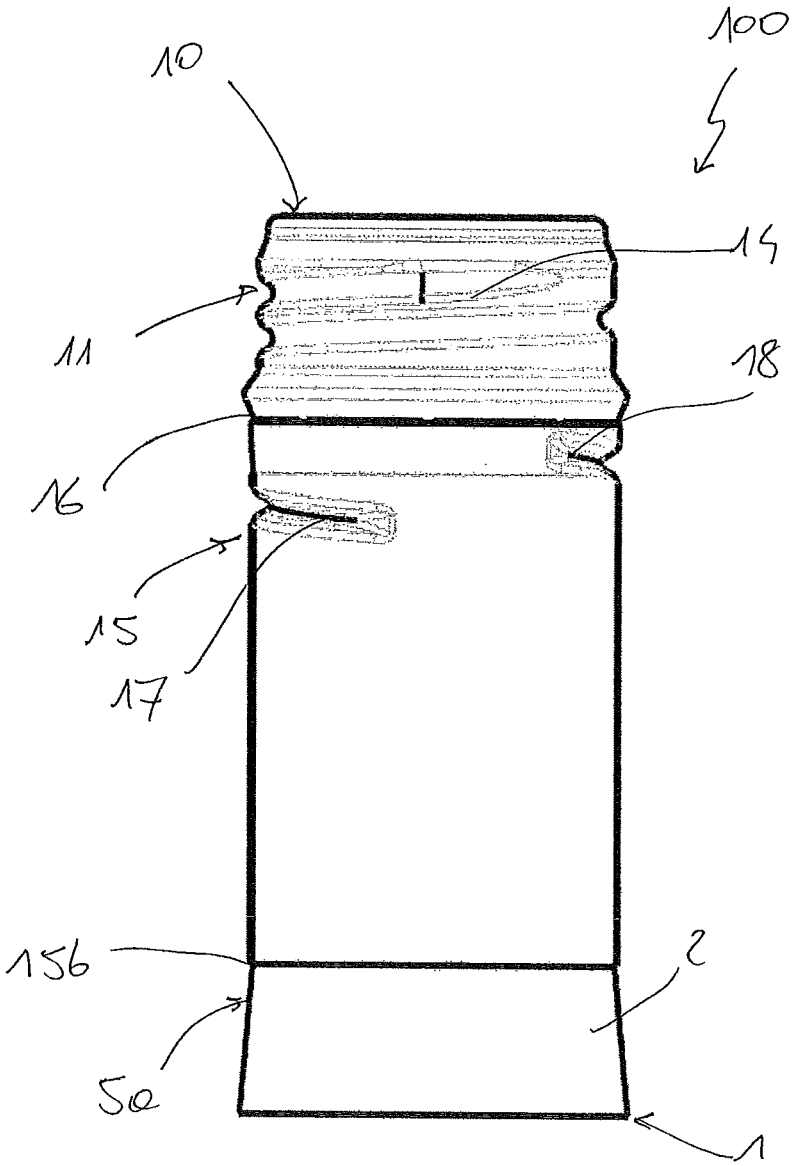
FIG. 7 shows a lateral view of an assembly of the neck of FIG. 5 and a closure according to a second embodiment of the invention.

In this arrangement, the first attachment portion 17 can be disengaged from the groove 8 and the skirt 15 can be slid off the neck 2 (i.e., the skirt 15 can longitudinally move outside the threads 6 of the neck 2, because as shown, for example, in FIG. 4, the maximum diameter D5 of the skirt is greater than the maximum diameter D3 of the projection 7, and the maximum diameter D5 of the skirt is eater than the maximum diameter D2 of the threads 6).

In order to assist the rotation of the skirt 15 and the enlargement of the diameter of the first attachment portion 17 as a result of the engagement with the ramp 9, the ramp 9 forms a slope angle ranging from 15° to 45° with the groove 8.

In one embodiment, the groove 8 extends in the projection 7 longitudinally beneath the frangible portion 16. Particularly, in a circumferential arrangement, the groove 8 is located beneath the frangible portion 16, whereas in a helical arrangement, where the first end 8*a* acts as the top end and the second end 8*b* acts as the bottom end, the top end 8*a* is located beneath the frangible portion 16. This will allow the frangible portion 16 to break upon first opening without altering the engagement of the skirt 15 with the projection 7, particularly with the groove 8 and the ramp 9.

The above disclosure clearly shows that the present invention fulfills the intended objects.

Those skilled in the art will obviously appreciate that a number of changes and variants may be made to the arrangements as described hereinbefore to meet incidental and specific needs. All of these variants and changes fall within scope of the invention, as defined in the following claims.

The invention claimed is:

1. An assembly, comprising:

a container with a neck and a mouth, said neck extending along a longitudinal axis and terminating on top in an annular rim that delimits the mouth, a tamper-evident closure coupled to said container for opening and closing said mouth, said neck comprising:

a tubular wall extending along said longitudinal axis between a lower portion and an upper portion, the annular rim being formed at a upper end of the upper portion, threads formed outside the tubular wall, longitudinally beneath and adjacent to said annular rim, such threads having a minimum diameter D1 and a maximum diameter D2 and longitudinally extending between a lower end of the threads and an upper end of the threads, a projection formed outside the tubular wall longitudinally beneath said lower end of the threads, said projection having a maximum diameter D3 that is greater than the minimum diameter D1 of the threads and less than or equal to the maximum diameter D2 of the threads, a groove formed in the projection and extending in a circumferential or helical direction, with a minimum diameter D4 that is less than the maximum diameter D3 of the projection and less than the maximum diameter D2 of the threads, between a first end of the groove and a second end of the groove, a ramp extending in the circumferential or helical direction to join the second end of the groove with a portion of the projection, to thereby join the minimum diameter D4 of the groove to the maximum diameter D3 of the projection, and said tamper-evident closure comprising:

a closure member configured to open and close said mouth, said closure member comprising a top wall and a sleeve, the sleeve being arranged coaxially outside the neck and longitudinally extending between said top wall and a bottom edge of the sleeve, said sleeve comprising threads removably engaged with the threads of the container, a skirt arranged coaxially outside the neck and longitudinally beneath the sleeve, said skirt longitudinally extending with a maximum diameter D5 between a top edge of the skirt and a bottom edge of the skirt, the top edge of the skirt being connected to the bottom edge of the sleeve using a frangible portion, which is configured to break upon first opening to allow removal of the closure member from the neck, said skirt having a first attachment portion and a second attachment portion, said first attachment portion being engaged in the groove to hold the skirt longitudinally attached to the neck upon the first opening and extending with a minimum diameter D6 between the first end of the groove and the second end of the groove, said second attachment portion being engaged with the ramp to join the first attachment portion having the minimum diameter D6 with a skirt portion having the maximum diameter D5, so that, upon removal of the closure member from the neck, the skirt can be rotated relative to the neck to bring the first attachment portion to engage against the ramp and enlarge its diameter to the maximum diameter D5 to thereby disengage the first attachment portion from the groove and allow the skirt to be slid off the neck.

2. An assembly as claimed in claim 1, wherein said container is made of glass.

3. An assembly as claimed in claim 1, wherein said container is made of plastic.

4. An assembly as claimed in claim 1, wherein said tamper-evident closure is made of metal.

5. An assembly as claimed in claim 1, wherein said groove extends in the projection longitudinally beneath said frangible portion.

6. An assembly as claimed in claim 1, wherein said ramp forms a slope angle ranging from 15° to 45° with said groove.

7. An assembly as claimed in claim 1, wherein the bottom edge of the skirt is joined to the lower portion of the tubular wall of the neck.

8. An assembly as claimed in claim 1, wherein said tamper-evident closure is made of aluminum.

9. An assembly, comprising:

a container with a neck and a mouth, said neck extending along a longitudinal axis and terminating on top in an annular rim that delimits the mouth, a tamper-evident closure coupled to said container for opening and closing said mouth, said neck comprising:

a tubular wall extending along said longitudinal axis between a lower portion and an upper portion, the annular rim being formed at an upper end of the upper portion, threads formed outside the tubular wall, longitudinally beneath and adjacent to said annular rim, such threads having a minimum diameter D1 and a maximum diameter D2 and longitudinally extending between a lower end of the threads and an upper end of the threads, a projection formed outside the tubular wall longitudinally beneath said lower end of the threads, said projection having a maximum diameter D3 that is greater than the minimum diameter D1 of the threads and less than or equal to the maximum diameter D2 of the threads, a groove formed in the projection and extending in a circumferential direction, with a minimum diameter D4 that is less than the maximum diameter D3 of the projection and less than the maximum diameter D2 of the threads, between a first end of the groove and a second end of the groove, a ramp extending in the circumferential direction to join the second end of the groove with a portion of the projection, to thereby join the minimum diameter D4 of the groove to the maximum diameter D3 of the projection, and said tamper-evident closure comprising:

a closure member configured to open and close said mouth, said closure member comprising a top wall and a sleeve, the sleeve being arranged coaxially outside the neck and longitudinally extending between said top wall and a bottom edge of the sleeve, said sleeve comprising threads removably engaged with the threads of the container, a skirt arranged coaxially outside the neck and longitudinally beneath the sleeve, said skirt longitudinally extending with a maximum diameter D5 between a top edge of the skirt and a bottom edge of the skirt, the top edge of the skirt being connected to the bottom edge of the sleeve using a frangible portion, which is configured to break upon first opening to allow removal of the closure member from the neck, said skirt having a first attachment portion and a second attachment portion, said first attachment portion being engaged in the groove to hold the skirt longitudinally attached to the neck upon the first opening and extending with a minimum diameter D6 between the first end of the groove and the second end of the groove, said second attachment portion being engaged with the ramp to join the first attachment portion having the minimum diameter D6 with a skirt portion having the maximum diameter D5, so that, upon removal of the closure member from the neck, the skirt can be rotated relative to the neck to bring the first attachment portion to engage against the ramp and enlarge its diameter to the maximum diameter D5 to thereby disengage the first attachment portion from the groove and allow the skirt to be slid off the neck.

10. An assembly as claimed in claim 9, wherein said container is made of glass.

11. An assembly as claimed in claim 9, wherein said container is made of plastic.

12. An assembly as claimed in claim 9, wherein said tamper-evident closure is made of metal.

13. An assembly as claimed in claim 9, wherein said tamper-evident closure is made of aluminum.

14. An assembly as claimed in claim 9, wherein said groove extends in the projection longitudinally beneath said frangible portion.

15. An assembly, comprising:

a container with a neck and a mouth, said neck extending along a longitudinal axis and terminating on top in an annular rim that delimits the mouth, a tamper-evident closure coupled to said container for opening and closing said mouth, said neck comprising:

a tubular wall extending along said longitudinal axis between a lower portion and an upper portion, the annular rim being formed at an upper end of the upper portion, threads formed outside the tubular wall, longitudinally beneath and adjacent to said annular rim, such threads having a minimum diameter D1 and a maximum diameter D2 and longitudinally extending between a lower end of the threads and an upper end of the threads, a projection formed outside the tubular wall longitudinally beneath said lower end of the threads, said projection having a maximum diameter D3 that is greater than the minimum diameter D1 of the threads and less than or equal to the maximum diameter D2 of the threads, a groove formed in the projection and extending in a helical direction, with a minimum diameter D4 that is less than the maximum diameter D3 of the projection and less than the maximum diameter D2 of the threads, between a first end of the groove and a second end of the groove, a ramp extending in the helical direction to join the second end of the groove with a portion of the projection, to thereby join the minimum diameter D4 of the groove to the maximum diameter D3 of the projection, and said tamper-evident closure comprising:

a closure member configured to open and close said mouth, said closure member comprising a top wall and a sleeve, the sleeve being arranged coaxially outside the neck and longitudinally extending between said top wall and a bottom edge of the sleeve, said sleeve comprising threads removably engaged with the threads of the container, a skirt arranged coaxially outside the neck and longitudinally beneath the sleeve, said skirt longitudinally extending with a maximum diameter D5 between a top edge of the skirt and a bottom edge of the skirt, the top edge of the skirt being connected to the bottom edge of the sleeve using a frangible portion, which is configured to break upon first opening to allow removal of the closure member from the neck, said skirt having a first attachment portion and a second attachment portion, said first attachment portion being engaged in the groove to hold the skirt longitudinally attached to the neck upon the first opening and extending with a minimum diameter D6 between the first end of the groove and the second end of the groove, said second attachment portion being engaged with the ramp to join the first attachment portion having the minimum diameter D6 with a skirt portion having the maximum diameter D5, so that, upon removal of the closure member from the neck, the skirt can be rotated relative to the neck to bring the first attachment portion to engage against the ramp and enlarge its diameter to the maximum diameter D5 to thereby disengage the first attachment portion fiom the groove and allow the skirt to be slid off the neck.

16. An assembly as claimed in claim 15, wherein said container is made of glass.

17. An assembly as claimed in claim 15, wherein said container is made of plastic.

18. An assembly as claimed in claim 15, wherein said tamper-evident closure is made of metal.

19. An assembly as claimed in claim 15, wherein said tamper-evident closure is made of aluminum.

20. An assembly as claimed in claim 15, wherein said groove extends in the projection longitudinally beneath said frangible portion.

* * * * *